US009856637B2

(12) United States Patent
Kontogounis et al.

(10) Patent No.: US 9,856,637 B2
(45) Date of Patent: Jan. 2, 2018

(54) BIDET FOR ATTACHMENT TO A TOILET BOWL

(71) Applicants: Zisis Kontogounis, Kozani (GR); Theofanis Kontogounis, Kozani (GR)

(72) Inventors: Zisis Kontogounis, Kozani (GR); Theofanis Kontogounis, Kozani (GR)

(73) Assignees: Zisis Kontogounis, Kozani (GR); Theofanis Kontogounis, Kozani (GR)

( * ) Notice: Subject to any disclaimer, the term of this patent is extended or adjusted under 35 U.S.C. 154(b) by 0 days.

(21) Appl. No.: 15/502,110

(22) PCT Filed: Jul. 22, 2015

(86) PCT No.: PCT/GR2015/000035
§ 371 (c)(1),
(2) Date: Feb. 6, 2017

(87) PCT Pub. No.: WO2016/046577
PCT Pub. Date: Mar. 31, 2016

(65) Prior Publication Data

US 2017/0226724 A1 Aug. 10, 2017

(30) Foreign Application Priority Data

Sep. 23, 2014 (GR) ..... 20140100497
Apr. 30, 2015 (GR) ..... 20150100191

(51) Int. Cl.
*A47K 3/022* (2006.01)
*E03D 9/08* (2006.01)
*B05B 15/08* (2006.01)

(52) U.S. Cl.
CPC ..... *E03D 9/08* (2013.01); *B05B 15/08* (2013.01)

(58) Field of Classification Search
CPC ..... E03D 9/08; B05B 15/08; A61H 35/00
USPC ..... 4/443, 445, 420.4
See application file for complete search history.

(56) References Cited

U.S. PATENT DOCUMENTS 4,069,519 A 1/1978 Alexander
4,197,594 A 4/1980 Butterfield
4,340,980 A 7/1982 Fushimi
5,359,736 A * 11/1994 Olivier ..... E03D 9/08 4/420.2
5,504,948 A 4/1996 Chandler
5,722,097 A * 3/1998 Deveer ..... A47K 3/26 4/420.4
5,933,881 A 8/1999 Smith
6,487,732 B1 12/2002 Smith
RE38,690 E * 2/2005 Moon ..... A61M 3/0225 4/420.1
2013/0269094 A1* 10/2013 Pace ..... E03D 9/08 4/447

FOREIGN PATENT DOCUMENTS

| | | |
|---|---|---|
| AU | 2011253729 | 5/2013 |
| CA | 2201177 | 9/1998 |
| DE | 10135947 | 1/2003 |
| GB | 2354530 | 3/2001 |
| GR | 20030100114 | 9/2004 |
| TW | 390928 | 5/2000 |
| WO | 9628620 | 9/1996 |

OTHER PUBLICATIONS

International Search Report for application No. PCT/GR2015/000035 dated Oct. 27, 2015.

* cited by examiner

*Primary Examiner* — Huyen Le
(74) *Attorney, Agent, or Firm* — Workman Nydegger

(57) ABSTRACT

A bidet for being attached to a toilet bowl comprising—a flexible skeleton that fits to the bowl rim and is stabilized by a metal hook, inserted inside the toilet's water's run off holes and a second wire attached to a seat screw on the underside of toilet, —an elastic tube, with a curve, which brings the water from a valve of quick or slow action to a hard tube's flush nozzle, which produces the water jet, wherein the hard tube, when in a no use position, lies, almost hidden, under the bowl's rim, and for being used is rotated on a shaft of the skeleton, so the flush nozzle comes out to about the center of toilet, pulled manually by a thread which acts on the curved elastic tube wherein after use the bidet moves automatically in the no use position, thanks to the elastic tube suitably arranged, which serves at the same time for water conduct.

9 Claims, 2 Drawing Sheets

BIDET FOR ATTACHMENT TO A TOILET BOWL

CROSS-REFERENCE TO RELATED APPLICATIONS

The present invention is a 35 U.S.C. §371 U.S. National Stage Application corresponding to PCT Application No. PCT/GR2015/000035, filed Jul. 22, 2015, which claims priority to Greek Patent Application No. 20150100191, filed Apr. 30, 2015 and Greek Patent Application No. 2014010100497, filed Sep. 23, 2014. The entire content of each of the aforementioned patent applications is incorporated herein by reference.

BACKGROUND OF THE INVENTION

1. Field of the Invention

The apparatus relates to a new type of bidet, which is attached to the right or left side of the toilet bowl rim, under toilet seat, for the purpose of creating of an upward vertical water jet and the sanitary cleansing of rectal or genital areas especially after defecation, menstruation etc.

2. Background

Bidets have been known for a long period of time. The following is a representative sample of related prior art as known to the inventor.

U.S. Pat. No. 6,487,732 B1 (SMITH WARREN[US], 3 Dec. 2002) discloses an improved bidet device which includes a rotatable handle and capstan for positioning a spray tube and for opening the supply of water to the tube for spraying. A screw is received by the capstan to mount the handle and is further provided with a radial port. An actuator is coupled to the screw for rotation of the screw relative to the capstan to modulate the flow of water through the device. The actuator may be ergonometrically designed.

DE 101 35 947 A1 (GHETMIRI MEHDI [DE], 30 Jan. 2003) discloses a device which has a sliding shower tube with upward directed shower. The shower is dimensioned so that it can be hidden in a housing, which is located in the rear section of the lavatory bowl (4) and formed integrally with it. The front of the shower is shaped and colored like the bowl. The conical shower end has rubber seals at front and back. The shower tube (1) is connected via a flexible hose to a ball valve, which opens the water flow after turning through 45 degrees. The valve is connected to a warm water supply (15) with limited temperature level, or to the domestic water system via a safety device.

U.S. Pat. No. 5,504,948 A (CHANDLER CHARLES [US], 9 Apr. 1996) discloses a bidet attachment which is built into a toilet seat, which toilet seat includes a chamber opening to the sides of the seat. The bidet attachment includes a spray nozzle connected to a water supply via lines and valves. The nozzle rotates from a storage position within the chamber of the seat to a use position over the toilet bowl. The supply lines and valves are housed within the seat with the threaded water inlet connectors and flow control knobs extending exteriorly of the toilet seat.

GB 2 354 530 A(POTES MORA MARIO [GB], 28 Mar. 2001) discloses an apparatus for attachment to a toilet bowl which comprises a mounting plate (6) which is securable to the rim of the toilet bowl, a controllable water supply conduit (1), the water supply conduit leading to a delivery pipe having a pyramidal-shaped nozzle (5) at the end, wherein the nozzle can be moved from an inoperative position adjacent the wall of the toilet bowl to an operative position in the centre of the bowl in which the nozzle is upwardly directed.

The up to now known attached bidets have many flaws relating to: 1. Not a 100% body cleansing effectiveness, due to distance from target, direction and angle of water jet. 2. Complexity in function and construction, which increases the cost to manufacture and lessens endurance. 3. Their place at the bowl, it allows parts of them to be easily spoiled by waste. 4. They are bulky or non-aesthetically prominent. 5. They don't allow the cleaning up of toilet part under them. 6. There have difficulties to be installed. 7. They might on use, damage the toilet bowl, or toilet seat. 8. They couldn't be attached to all kinds of toilets, or there is need to inflict changes to toilet seat. 9. They don't take care of small children at home, which can go to the toilet room and make mess of it. In addition, using buttons, in order to choose different water jet pressures, make obvious that width of choose is restricted by. 10. Some need to have imposed different adjustments for men and women.

This new type of bidet we are proposing at produces an upwards vertical water jet, so to impose perfect body cleansing, even in cases of hemorrhoids, it is simple in construction and function, easy to use, easy to manufacture, so very cheap, easy to repair it and so long lived. At no use position the tube with flush nozzle lies under the bowl rim, so practically it never gets spoiled and It is almost invisible from above. It allows the toilet part under it to be easily cleaned up. It could easily get be installed without any invasion on toilet seat or bowl, and no screwdrivers are involved. It could easily get attached to any toilet type and can be used without any change by men and women. Using a water valve of slow action (multi-strophic) for water amount and pressure control, small children could not be able to <> wrongly function it. In addition it gives innumerable pressure chooses.

It has the following special features, in relation to existing bidets, that render the apparatus very simple, slim, but unsurpassed, as regards function and duration: Part of the water conduction system is comprised of a flexible elastic tube. This and its special arrangement give flush aluminum tube the ability to rotate around a shaft, specially its short branch under the toilets rim and, thanks to elastic tube's elastic resistance to distortion it retracts it automatically back to its non use position when the work is done. Rotation of flush tube, to reach to use position, is done by slight pulling of a plastic thread. The necessary stabilization of the apparatus is succeeded by means of a metal skeleton, a wire hook that is inserted into the bowl holes, {that lie under the rim and which let the water to run in the toilet) and an unseen wire that attaches to cover's or basin's underneath screws. These all make the apparatus very simple, slim, easily manufactured and easily being repaired.

DETAILED DESCRIPTION

Figure 1:
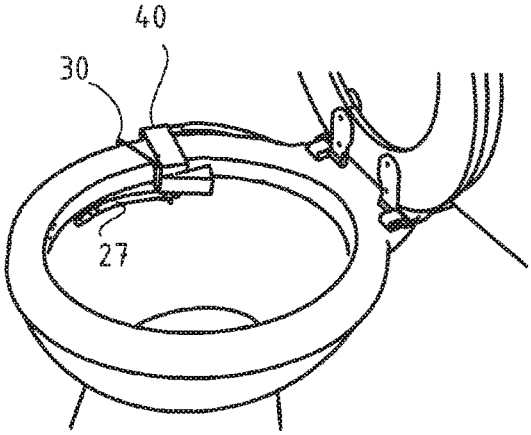
FIG. 1: view of the device from left and above, as we are sitting on the bowl, in no use position.
Figure 2:
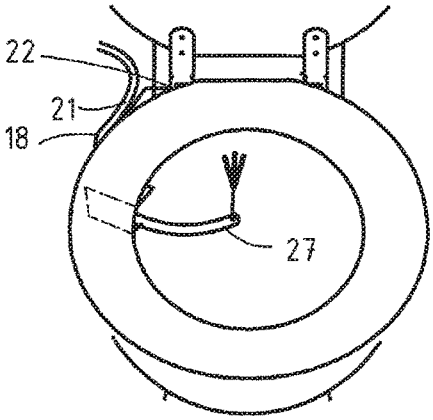
FIG. 2: the device in use position.
Figure 3:
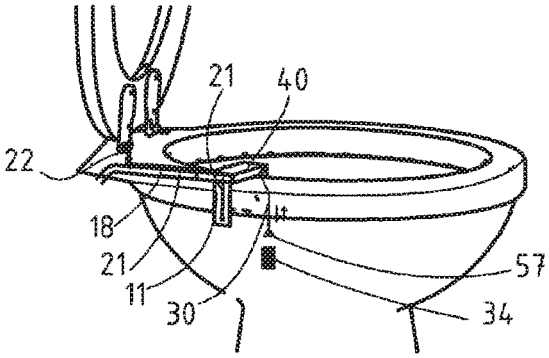
FIG. 3: view from right and above.
Figure 5:
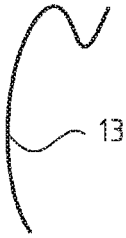
FIGS. 5 and 6: additional supporting stabilizing parts.
Figure 4:
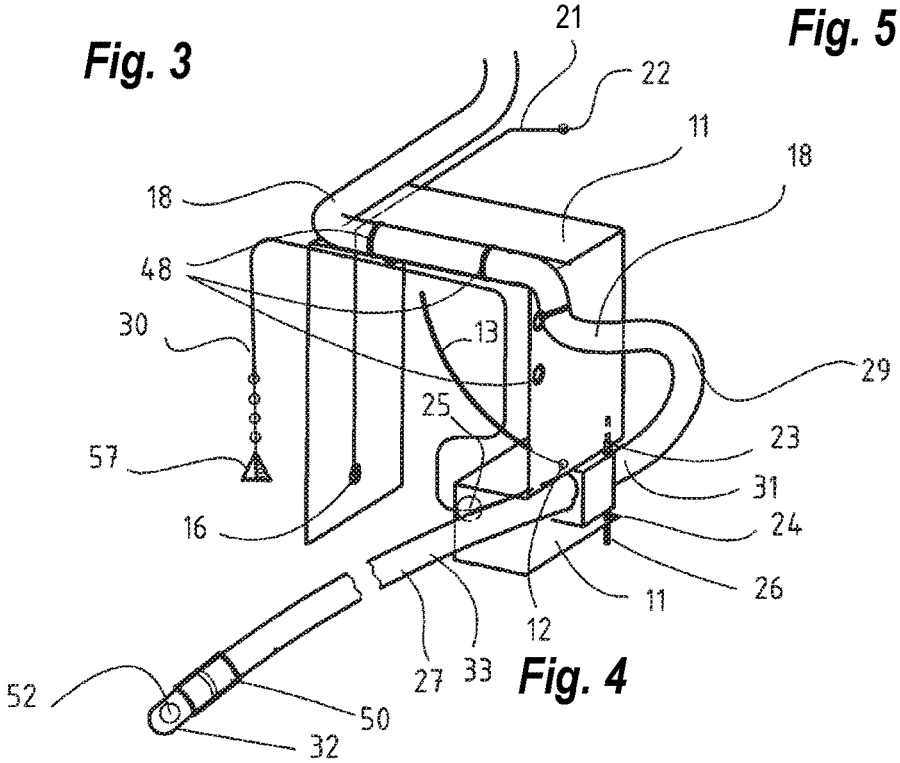
In FIG. 4: stabilizing skeleton and additional stabilizing parts, water supply and conduction part, rotation system to use and non use position, the plastic thread for pulling, and the hard tube with flush nozzle.
Figure 6:
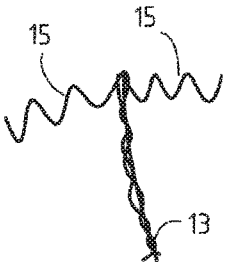
Figure 7:
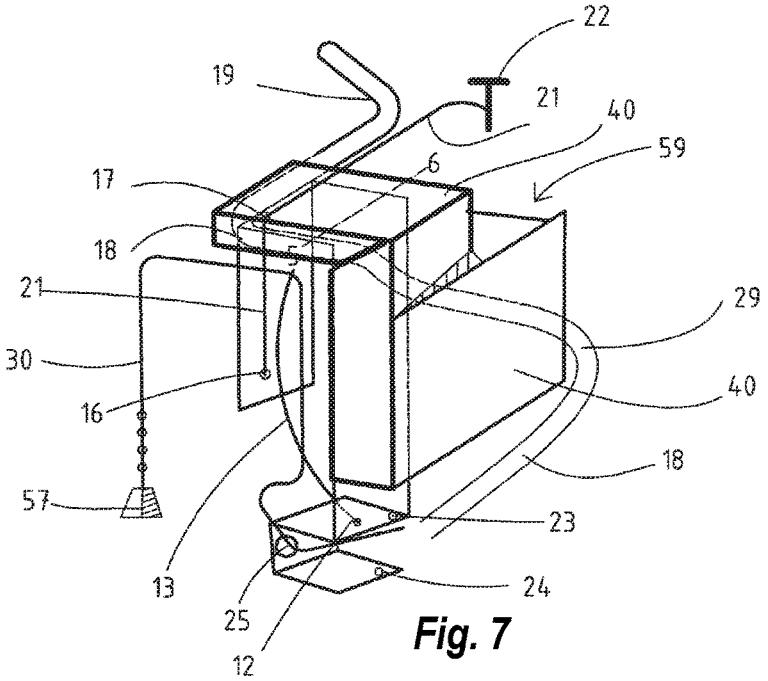
FIG. 7: the device with the cover added. In all above figures the apparatus is attached on the one side of bowl. It can be on the other as well. On this case would be necessary to change the direction of cover and its moulding.
Figure 8:
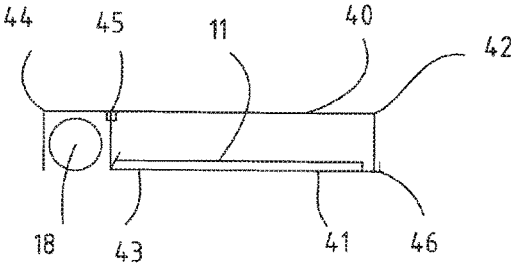
FIG. 8: a vertical section of the device at line 5-6, FIG. 7, FIG. 10. 18: is the elastic tube, 40: the plastic cover, 41: its angled part, that is removable and fits with 40 at points 45, 46, the aluminum stripe, 11, which is kept steady by small indent. Height, 42-46 must be no more than 10 mm.
Figure 9:
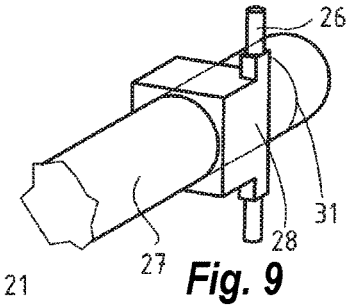
FIG. 9: a fragmentary part of the rotation system.
Figure 10:
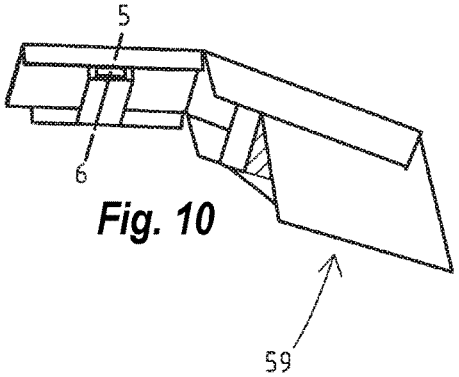
FIG. 10: the under surface of cover.

The apparatus has the following parts: The stabilizing part, the part of water supply up to a hard tube's flush nozzle, the system of restricted rotation of the hard tube, the system of pulling the hard tube to use, and its automatic return to no use position, the plastic cover.

Stabilizing Part

FIG. A, C, D, E, F, G, H, is made from flexible plastic or better from thin aluminum sheet stripe, number 11, about 24-28 cm long, which fits to the rim o any type of toilet. At point 12 a piece of hard stainless like hook wire, 13, fig D, G is fixed. Its length changes in different toilets, according to each rim's height. It is inserted to any one of the holes (rather at the back of the bowl) we choose, under its rim, in a way that it reaches the hole's upper roof. It is 1.5-3 cm longer from hole or channel's depth, so aluminum stripe is kept in a distance of 1.5-3 cm from the toilet wall. In cases where there are no holes but a channel, the hook is possible to be extended in a way that it touches channel's walls, FIG. E, or we use the additional wires, 14, firmly rounded up around hook 13, and then extended like wings, 15, as shown in FIG. F.

As a second parallel mechanism of stabilization, for both types (with holes or channel) of toilets, a piece of wire 21 is attached, successively, at points 16, 17 of the aluminum stripe, fig D, and joining the elastic or plastic tube, 18, or 19, (so being almost unseen), it reaches seat's or tank's under screw, 22, where is attached to it.

Along the one or the other side of aluminum stripe there are many holes in a row, 48, at a distance to each other of about 1 cm, where we choose (it depends to toilet type) to attach the elastic tube 18, FIG. D, (it is better if it is on the same side with the flush nozzle), 32, FIG. D, in order to exert more elastic resistance to its distortion, so to retract back hard tube more easily. First hole is about 5-7 cm away from shaft 26.

The other end of the skeleton stripe is about like a c, FIG. D, G. Its horizontal parts are 1.5-2.5 cm long and have the holes 23, 24. The vertical part is 1.5-2.5 long, and has a hole, 25, with very much smooth edges (in order to avoid traumatizing the plastic thread, 30, which passes through it. This can be secured by metallic or plastic grommet. In holes 23, 24, is rotating a shaft, 26 FIG. D, FIG. K, which is attached to aluminum hard but light tube, 27, through a plastic block, 28, FIG. D, FIG. K. The tube 27 at its end has a hole, 36, 1-4 mm wide, (flush nozzle), FIG. D, and is about horizontally partially rotating, through shaft 26, in a plain at sufficient, but the least distance below the upper part of the toilet seat, so to avoid the flash nozzle to get in touch with user's body. There could be an important variation: There are cases where for different reasons, installation of the device is easier and more functional, if the hook is inserted to a hole, which is nearer to front part of toilet, than the back one. On such occasion its direction is opposite to that shown on FIG. A Water Supply Section Parts of it coincide with parts of the rotation system. There is no need to describe the details of connection of apparatus with the city water supply system, but it is essential to note that, as in some areas the water pressure is very high, we must reduce it by using the existing switch of toilet tank or another one added to the supply line. This is done at city water bigger supply hour: we screw up the switch, once and for all at the beginnings, so to reduce water pressure and so prevent possible rupture of the elastic tube. There is a second valve, which is connected straight to the elastic tube, 18, or if a plastic tube, 19, is intervened for aesthetic purposes, with it, and this in turn is connected with the elastic one at point 58. The second valve that regulates the pressure of the water jet, attached after the previous switch, can be of quick or slow action.

Tube 18 is of 6-9 mm external diameter and 5-8 mm internal one. At point 29 the tube makes a curve, so to allow the rotation of tube 27, under the toilet rim, by the manual pull action of the plastic thread, 30, FIG. D, FIG. C, FIG. G. On the other hand this curve is necessary to secure automatic return rotation to no use position of tube 27, thanks to elastic tube's resistance to above described manual first rotation, by thread's pulling. Tube 18 is connected to tube 27 at 31 point. Tube 27 is hard but light, plastic or aluminum.

The tube, 27, at its end has a hole 1-4 mm wide, (flush nozzle), 52, and is about horizontally partially rotating, through shaft 26, in a plain below well enough the upper part of the toilet seat, about 6-9 cm, so to avoid the flush nozzle to get in touch with the user's body, but at the same time not far away, so the water jet can be strong and effective. Flush nozzle can have more than one hole. There could be two parts of tube 27, part 32 and part 33, connected with a piece of plastic tube, 50, so to be possible for somebody to extent or lessen the tube 27, according to toilet width.

System of Pulling and Rotating of Hard Tube to Use and its Retraction to no Use Position For the purpose of the partial rotation of tube 27, so its flush nozzle to come about the center of toilet in use position (best distance from back rim: 8-14 cm), FIG. B, a durable synthetic thread, 30, FIG. A, FIG. C, FIG. D, FIG. G, is used. It is firmly attached at point 31 of tube 27. Through hole 25, FIG. D, FIG. G, the thread comes out of the toilet. The pulling is made manually, at point 57, where a light plastic ball or bell is attached. This ball is covered partially or all round by a piece of sticking cloth, which is pressed upon a second piece with the opposite texture, which is attached to toilet's outer surface, 34, FIG. C. User holds the thread with the one hand while the other regulates the water flow. Or he can stick the ball, which has been partially or wholly covered by a piece of adhesive cloth, on a corresponding adhesive piece of cloth, 34. This is useful for old people, or persons with kinetic problems, pregnant women etc. Divorcing of two sticker cloth pieces, or stopping pulling the thread manually, it lets tube 27 to be retracted back to no use position. The thread is attached to tube 27, or the elastic tube, 18, near the shaft 26, point 31. For aesthetic purposes the end part of the thread, that is lying at the outer surface of toilet, could be replaced by a piece of very light, thin plastic or metal chain.

As it was said before, retraction of tube 27, in no use position, is succeeded automatically, by tube's 18 and its curve 29, elastic resistance to distorting action on this tube by thread manual pull action. This is enhanced by tube's 18, turning around at the points of its attachment to the metal skeleton, the nearest to its curve. Tube 27, if metallic is firmly attached to a plastic block, 28, that has the metallic or plastic shaft 26, that rotates between skeleton holes 23 and 24 FIG. D, FIG. K, and if plastic, it has embodied the plastic shaft. In its rotation, tube 27 stops at an angle of about 70-90 degree, as it drives onto the skeleton stripe. Shaft 26 divides tube 27 to two parts, short and long, while, the short one is rotating under the rim.

Plastic Cover

FIG. G shows a view of cover, 40. FIG. H is a vertical section of the device at line 5-6. It is of importance that height, 42-46, FIG. H, is no more than 10 mm, (the best is 7-8 mm) and roofs, 44-45, thickness is as less as possible, so the device would not be probable to be squashed between the toilet seat and the bowl rim. Also, tube 18 should not be restrained in its movements by cover at its curve area, 29. For that purpose there is a widening, 59, of cover, FIG. G, FIG. L. As bowls have rims of differing size and bents, between the horizontal's and vertical parts of cover there is a flexible line as shown at FIG. G, fig, L, in order to get cover adjustable to any difference of bowls. Again cover must be of various sizes. To elongate it, plastic pieces can be added by clipping them to the main body, at both ends, or there must be many plastic moulds. In cases Generally the idea of the cover is to hide the view of device's parts from above.

The device is very simple and compact, practical and economical to manufacture, convenient to use, and requires no altering of the plumping fixture.

It is to be understood that the form of the invention herewith shown and described is to be taken as preferred example of the same, and that various changes in the shape, size and arrangement of parts may be resorted to, without departing from the spirit of the invention or scope of the subjoined claims.

The invention claimed is:

1. A bidet for being attached to a toilet bowl comprising:

a stabilizing part, a part of a water supply which includes a tube with a flushing nozzle;

a system of restricted rotation of the tube with the flushing nozzle including a system of pulling the tube to a use position and its return to non-use position; and a plastic cover, wherein:

the bidet additionally comprises:

a system for automatic return of the tube comprising an elastic tube which makes a curve, thereby allowing a partial rotation of a short part of the tube, under the toilet rim where rotation is done by user's manual pulling of a thread attached to the short part of the tube and where the elastic tube and its curve secures hard tube's automatic return to a non-use position due to elastic resistance to distortion.

2. The bidet according to claim 1, wherein the bidet can be connected to a hot water supply which is mixed with an ambient water supply.

3. The bidet according to claim 1, wherein the water valve is of quick or slow action.

4. The bidet according to claim 1, wherein:

the tube comprises two parts, with the flushing nozzle connected through a connecting piece of the tube, wherein the connecting piece enables the tube to:

extend or lessen the length of the tube by increasing the distance between the two parts inside the connecting piece, or by shortening the one connected part of the tube; and to change the direction of the water jet by at least partly turning the end part of the tube.

5. The bidet according to claim 1, wherein:

the bidet is configured to be hooked to front rim holes, so that direction of the device is opposite such that the flushing nozzle is looking towards a back side of the toilet bowl.

6. The bidet according to claim 1, further comprising:

a metallic hook that is inserted to the toilet channel and is extended to one or two wings.

7. The bidet according to claim 1, further comprising:

two parallel wires tightly attached to a metallic hook, wherein the two parallel wires are turned tightly around the metallic hook and open wide, thereby forming two wings.

8. The bidet according to claim 1, wherein the flushing nozzle comprises a plurality of holes.

9. The bidet according to claim 1, further comprising a piece of light metallic or plastic chain positioned about the thread at one end, wherein the light metallic or plastic chain is connected to a plastic bell or ball, wherein the plastic bell or ball is covered by a self-sticking cloth.

* * * * *